US011707661B1

(12) United States Patent
Magrino et al.

(10) Patent No.: US 11,707,661 B1
(45) Date of Patent: Jul. 25, 2023

(54) UNDERWATER STRIKING BAG DEVICE AND METHOD OF USING THE SAME

(71) Applicants: Robert Magrino, Woodinville, WA (US); Bernadette D'Souza, Woodinville, WA (US)

(72) Inventors: Robert Magrino, Woodinville, WA (US); Bernadette D'Souza, Woodinville, WA (US)

( * ) Notice: Subject to any disclaimer, the term of this patent is extended or adjusted under 35 U.S.C. 154(b) by 0 days.

(21) Appl. No.: 17/835,093

(22) Filed: Jun. 8, 2022

(51) Int. Cl.
*A63B 69/22* (2006.01)
*A63B 71/06* (2006.01)

(52) U.S. Cl.
CPC ..... *A63B 69/22* (2022.08); *A63B 2071/0694* (2013.01); *A63B 2208/03* (2013.01); *A63B 2225/60* (2013.01)

(58) Field of Classification Search
CPC ..... A63B 69/22; A63B 2071/0694; A63B 2208/03; A63B 2225/60; A63B 69/208; A63B 21/0084; A63B 2071/026; A63B 2225/093; A63B 2225/605; A63B 23/03575
See application file for complete search history.

(56) References Cited

U.S. PATENT DOCUMENTS 1,890,696 A * 12/1932 Rosenhahn ..... A63B 69/224 482/90
2,186,403 A 1/1940 Bullis
3,069,162 A * 12/1962 Samuel ..... A63H 1/32 482/121
3,234,685 A * 2/1966 Harrowe ..... A63H 15/06 446/221
4,039,736 A * 8/1977 Nettleton, Jr. ..... A61P 31/04 435/78
4,103,889 A * 8/1978 Lobur ..... A63B 69/305 273/DIG. 20
4,527,796 A * 7/1985 Critelli ..... A63B 69/222 482/901
4,557,478 A * 12/1985 Levine ..... A63B 69/305 482/89
4,787,875 A 11/1988 Baron
4,822,031 A 4/1989 Olschewski
4,883,271 A * 11/1989 French ..... G01L 5/14 482/84
5,330,403 A * 7/1994 Kuo ..... A63B 69/224 482/90
5,967,952 A * 10/1999 Bronstein ..... A63B 21/0606 482/106

(Continued)

FOREIGN PATENT DOCUMENTS

WO WO2012001536 1/2012

*Primary Examiner* — Garrett K Atkinson
(74) *Attorney, Agent, or Firm* — R. William Graham

(57) ABSTRACT

An underwater punching bag device having a bottom section, a mid section, an upper section, a porous support member extending between the upper and the mid section and connected to an internal side of the bag. A closed cell foam member is disposed above the porous support member and maintained in the upper section, a valve communicably disposed on the bag. A top opening extends from a top of the upper section through and communicates with the mid section and the bottom section to permit fluid to pass thereto and a reclosable member connects to the top about the top opening.

15 Claims, 2 Drawing Sheets

(56) References Cited

U.S. PATENT DOCUMENTS 6,080,089 A 6/2000 Nicholson
6,106,443 A * 8/2000 Kuo ..... A63B 69/34 482/90
6,827,674 B1 * 12/2004 Ferry ..... A63B 69/305 482/90
6,994,658 B2 * 2/2006 Laudenslager ..... A63B 69/305 482/90
7,335,136 B2 2/2008 Brodbeck
7,344,482 B2 3/2008 Checketts
7,704,194 B1 * 4/2010 Chen ..... A63B 69/224 482/90
7,758,476 B2 * 7/2010 Chu ..... A63B 69/222 482/86
8,652,014 B2 * 2/2014 Smith ..... A63B 69/305 482/90
9,186,565 B2 * 11/2015 English ..... A63B 23/047
9,199,151 B2 * 12/2015 Fu ..... A63B 69/305
9,586,119 B2 * 3/2017 Fu ..... A63B 69/222
9,737,780 B1 * 8/2017 Khunkhun ..... A63B 69/305
10,350,474 B1 * 7/2019 Magrino ..... A63B 21/0084
10,981,030 B2 * 4/2021 Henniger ..... A63B 21/0603
2002/0086776 A1 * 7/2002 Fields ..... A63B 69/305 482/86
2002/0115538 A1 * 8/2002 Wen ..... A63B 69/34 482/83
2004/0097348 A1 * 5/2004 Laudenslager ..... A63B 69/305 482/86
2004/0110607 A1 6/2004 Crespo
2005/0159275 A1 7/2005 Bullman
2006/0025285 A1 2/2006 Giusti
2007/0099772 A1 * 5/2007 Fu ..... A63B 69/305 482/83
2008/0125293 A1 * 5/2008 Ng ..... A63B 69/32 482/84
2008/0188360 A1 * 8/2008 Chu ..... A63B 69/305 482/83
2011/0223826 A1 * 9/2011 Gibson ..... A63H 23/00 446/153
2011/0312433 A1 * 12/2011 Parenti ..... A63B 69/0002 473/422
2012/0157269 A1 * 6/2012 Fu ..... A63B 69/20 482/86
2012/0246884 A1 * 10/2012 Wilson ..... A63B 69/305 24/302
2013/0123084 A1 * 5/2013 Miklosi ..... A63B 21/0603 482/148
2014/0003118 A1 1/2014 Jones
2014/0031180 A1 1/2014 Jones
2014/0066268 A1 * 3/2014 Hafeken, Sr. ..... A63B 69/22 482/85
2014/0226919 A1 * 8/2014 Fu ..... A63B 69/20 383/3
2014/0336014 A1 11/2014 Francis
2015/0057132 A1 * 2/2015 Pedone ..... A63B 69/34 29/428
2015/0080194 A1 * 3/2015 Lin ..... A63B 69/224 482/86
2015/0273306 A1 * 10/2015 Fu ..... A63B 69/305 482/87
2016/0039502 A1 2/2016 Pajonk-Taylor et al.
2017/0209761 A1 * 7/2017 Magrino ..... A63B 69/224
2018/0127072 A1 * 5/2018 Chiu ..... B63C 9/155
2020/0094097 A1 * 3/2020 Gonzalez ..... A63B 21/0084

* cited by examiner

UNDERWATER STRIKING BAG DEVICE AND METHOD OF USING THE SAME

BACKGROUND OF THE INVENTION

Field of the Invention

The invention generally relates to underwater exercise. More particularly, but not by way of limitation, to an underwater striking bag device and method of using the same.

Prior Art

The instant invention is an improvement over the inventor's prior invention as described in U.S. patent Ser. No. 10/350,474B issued Jul. 16, 2019 Oct. 26, 2017. As discussed therein, it is common knowledge that aquatic exercise is beneficial for conditioning and for strengthening muscles. Water resistance provides a low-impact workout to increase cardiovascular fitness and muscle strength without excessive stress on the body. The device aimed at providing an optimal workout for the user while minimizing the risk of injury, and provided an overall cardiovascular workout as well as strengthening of the upper, lower, and core muscle groups and increasing the exerciser's coordination. The device offered a compact and lightweight, easy to assemble and disassemble, transportable design. While this was a significant improvement over the prior art, the device lacked some versatility. Accordingly, it would be desirable to have an improved exercise device that could be used individually or in groups and while maintaining the prior advantages also enhanced versatility of the device. The invention is an improvement in the field of exercising and overcomes some of the deficiencies with prior aquatic fitness device.

SUMMARY OF THE INVENTION

An object of the invention is to provide an underwater exercise bag device with improved versatility.

Another object of the invention is to provide an underwater exercise bag device with decreased setup.

Yet another object of the invention is to provide a low impact form of exercise that lessens the chance of injury Still another object is to provide a method of exercising using an underwater punching/kicking bag device for physical fitness, rehabilitation, and recreation.

Still it is the object of this invention to provide a simple exercising device that provides an exercise workout for the arms, legs, and core area.

A still further object of the invention is to provide a light-weight easily transportable exercise device.

Another object of this invention is to provide an exercise device that can be used by persons of any size who are capable of standing in a pool or shallow body of water.

A still further object of this invention is drawn to a method of achieving total body fitness workout by using the exercise device according to this invention.

Yet another object is to provide a multifunctional exercise device which serves in one mode as a storage and carrying bag and in another mode as an underwater punching/kicking/fitness bag.

It is an object to provide one or more method of exercising.

Accordingly, the invention is directed to an underwater punching bag device and method of exercising using the same. This invention includes an underwater striking bag device, which includes a bottom section, a mid section, an upper section, a porous support member extending between the upper and mid section and connected to an internal side of the bag, a closed cell foam member disposed above the porous support member and maintained in upper section, a valve communicably disposed on the bag, preferably to upper section for receiving air therethrough.

A top opening extends from a top of the upper section through and communicates the mid section and bottom section to permit fluid to pass thereto. A reclosable member, which is preferably a waterproof seal, connects to the top about the top opening. At least one handle is connected to the underwater striking bag for assisting in filling and removal of water into said lower compartment.

A weight can be provided and maintained in the bottom section for stability and buoyancy, maintaining the bag in a vertical position when deposed in water. Optionally, the device can include another porous support member extending between the mid section and bottom section and connected to the internal side of the bag, and another closed cell foam member below the second porous support member and maintained in bottom section can be employed to maintain the bag in a horizontal position when disposed in water.

The bag includes bottom section removably receiving a weight, such as a padded weight, within a closable flap of the bottom section. One or more handle can be disposed on the bottom section.

DETAILED DESCRIPTION

Figure 1:
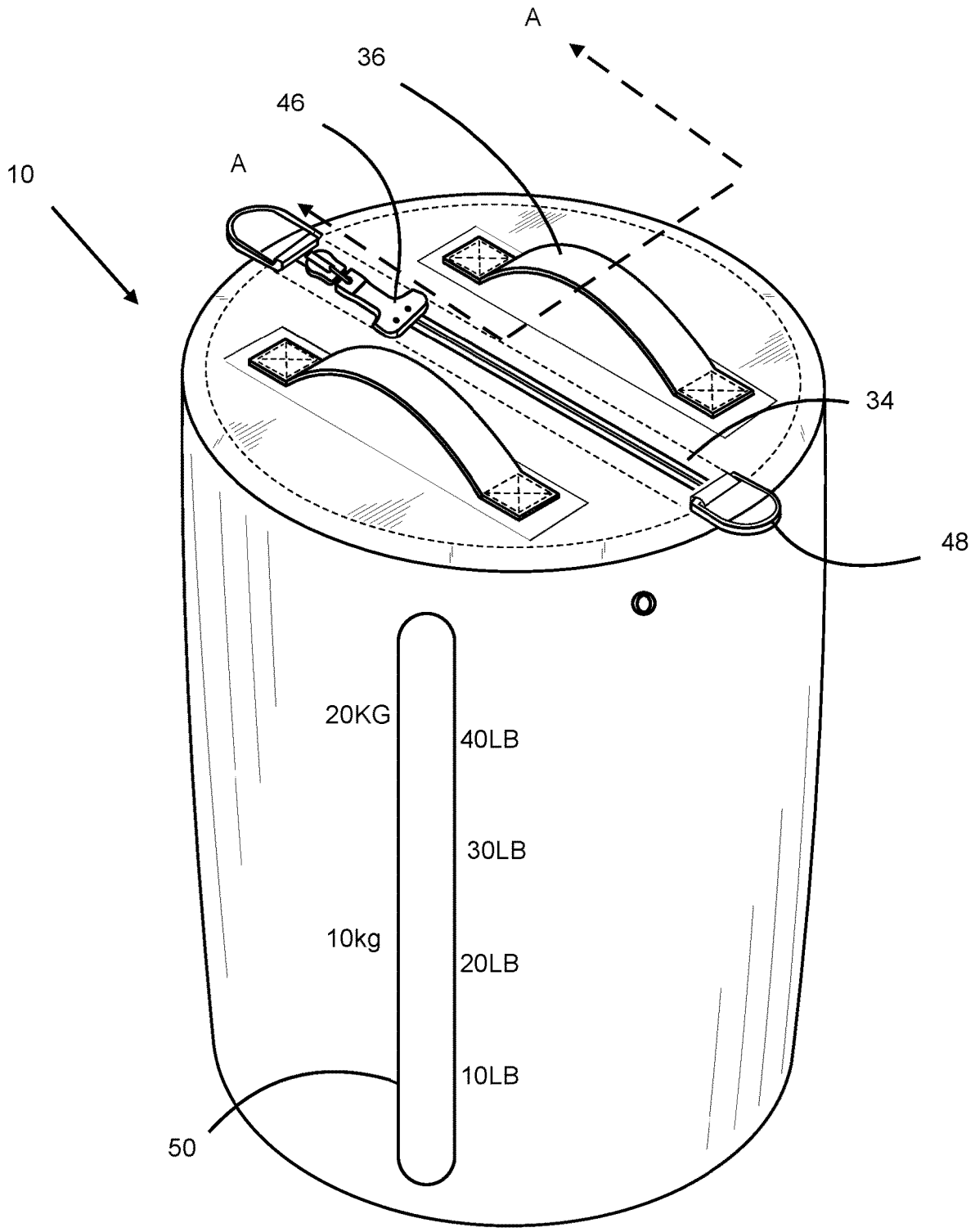
FIG. 1 is a perspective illustration of the invention.
Figure 2:
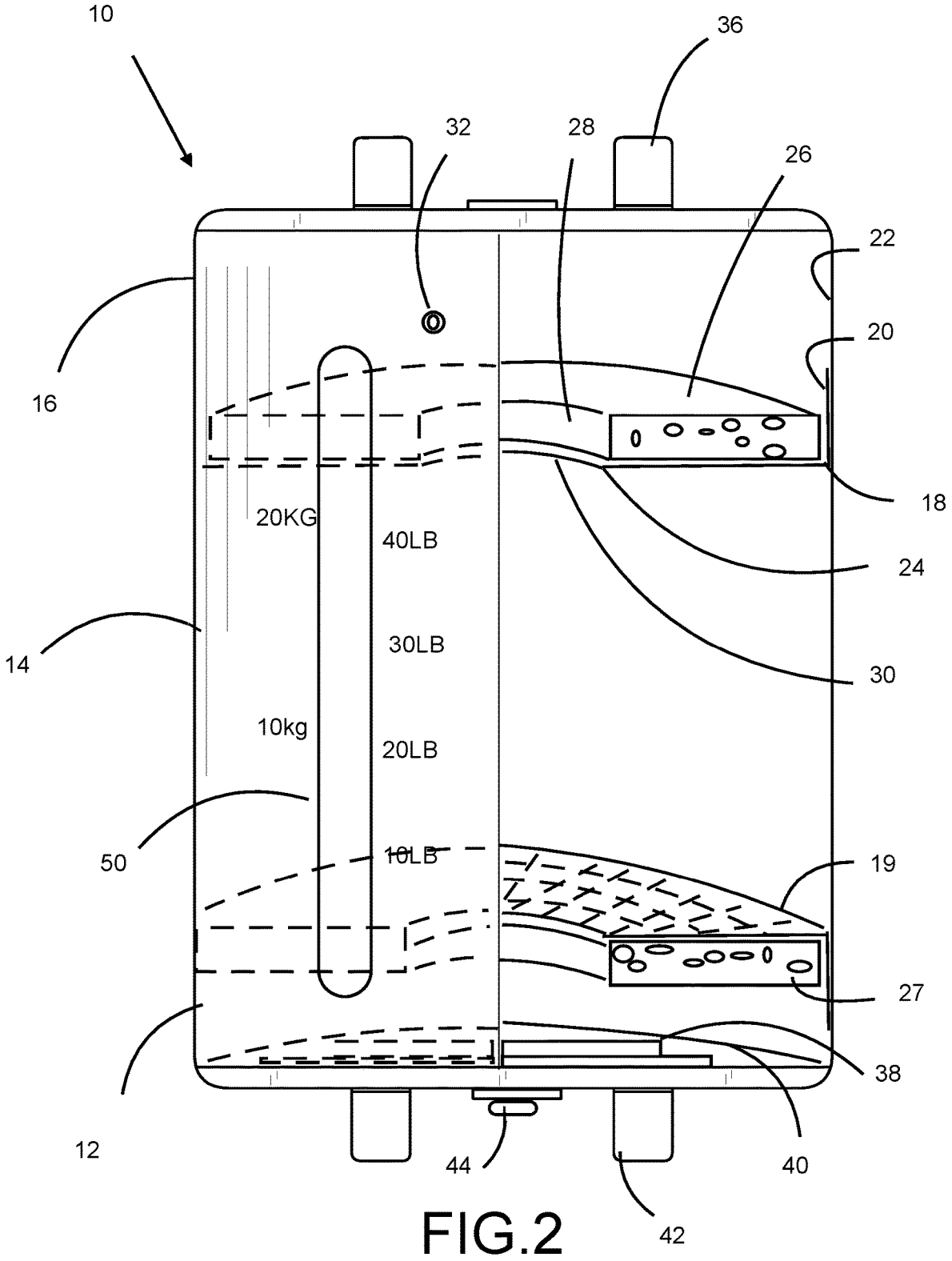
FIG. 2 is a partial sectional view through line A-A of the embodiment of FIG. 1.

Referring now to the figures, the underwater striking bag device of the present invention is represented generally by the numerals 10. Like numerals refer to like parts.

The underwater punching bag 10 and method of exercising using the same is provided. This invention includes an underwater striking bag 10, which includes a bottom section 12, a mid section 14, and an upper section 16.

At least porous support member 18 extends between the upper section 16 and mid section 14 and in a preferred embodiment can be made of a porous mesh material and has one peripheral portion 20 connected to an internal side 22 of the bag 10 and a remaining annular mesh portion 24 serving as a retainer a closed cell foam member 26 which is maintained in the upper section 16 above the porous support member 18. The closed cell foam member 26 is here shown as annular thus defining a central opening 28 alignable with a central opening 30 of the remaining annular mesh portion 24 providing free flow communication from the upper section 16 to the mid section 14. As indicated, there can optionally be a porous support member 19 similarly formed to porous support member 18 and another closed cell foam member 27 both providing communication between the mid section 14 and bottom section 12.

The closed cell foam member 26 and 27 serve as floats and aid to maintain the bag in either a vertical position when only closed cell foam member 26 is used or horizontal position when both are employed. A valve 32 communicably disposed on the bag 10, preferably to upper section for receiving air therethrough. Through the valve 32, the buoyancy can be adjusted to achieve the desired position when submerged in water.

A top opening extends along the upper section 16 through a reclosable member 34, which is preferably a waterproof seal zipper which connects on top and when opened permits the top opening to communicate with the upper section 16, mid section 14 and bottom section 12 to permit fluid to pass thereto. At least one handle 36 is connected to the underwater striking bag 10 for assisting in filling and removal of water.

A weight 38 can be provided and maintained in the bottom section 12 for stability and buoyancy, maintaining the bag 10 in a vertical position when deposed in water. Optionally, the bag 10 can include the other closed cell foam member 27 below the second porous support member and maintained in bottom section 12 to maintain the bag 10 in a horizontal position. The bag 10 includes bottom 40 section receiving a weight 38, and can be equipped with padding and a enclosure for the same. One or more handle 42 can be disposed on the bottom section. Further, a smaller loop 44 can be provided on bottom section 12 of bag to connect tether cord if so desired. An ankle strap or fixed connection point can be provided to connect to the bag 10 to further assist in limiting movement relative to the user during a workout.

The bag 12 is comprised of an exterior surface which includes a flexible water impermeable material, such as polymeric material. The bag 12 has a pull tab 46 connected to waterproof zipper 34 shown as a T-shaped. Additionally, fixed pull tabs 48 can be provided on a top surface to aid in closing and opening the zipper 34. A transparent window 50 used to gauge the amount of weight (water/air) inside the bag. The scale will run vertically up the side. The window will have a measurement scale (LB & KG) 10 LB, 20 LB, 30 LB, 40 LB etc. and 10 KG, 20 KG at each measurement point). This transparent window 50 spans across a section of the bag to permit visual inspection of an amount of fluid therein and can be provided with indicia indicated an amount of water and in turn corresponding weight added.

As improvements over the inventor's prior device, the prior air chamber has been removed and replaced with a buoyant foam ring 26, preferably removable and a closed cell foam, held in place by mesh shelf 18. In addition, valve 32 allows introduction of additional air to regulate the device's buoyancy. These three innovations make the bag 10 more versatile. The design allows device to setup in half the time of previous model. This further provides for better variable weight control of bag 10. Simply remove water through reclosable member 34, and replace the water with air to quickly change the bag from full water capacity weight or anywhere between the bag's empty weight in a few seconds. If necessary, inflate air inside the water chamber to increase buoyancy and to retain the bag's 10 cylindrical shape. One can quickly increase the bag from its empty weight to its full capacity weight by adding water through reclosable member 34 and zipping the bag shut.

The second mesh shelf 27 could be added to the bottom of the bag to hold a second foam ring 19. This would orient the bag 10 in a more horizontal position for varying exercise or physical therapy.

Exercises include above water weight training, such as lifting bag above water. The new design allows variable weight control by regulating the volume of water and air inside the bag 10.

The bag 10 also provides for below water drag training. One can move bag 10 underwater as a drag and resistance device. In addition, the bag 10 provides variable weight as it transitions from below water to above water. Buoyant force helps propel bag 10 upward as it transitions from underwater to above water creating an assisted lift for the exerciser until the weight of water and gravity act against the bag 10.

Balance and step-up drills. The bag is neutrally buoyant and can be pushed to the pool floor allowing exerciser to stand on bag 10 for step-up exercises and for balance drills.

In addition to lifting exercises, the bag can be used for pulling drills by connecting a harness/tether to bag 10 and pulling the bag 10 bag through water. The bag 10 can also be used for buoyancy resistance exercise where the bag is first filled with air and then bag is pushed below water creating buoyancy resistance.

The bag 10 can be used for land-based exercise as a variable weight sandbag-type device. The bag can be used at full water weight capacity, or with reduced weight by changing the ratio of water and air. In addition, the bag 10 can be used as an underwater punching and kicking bag.

The present invention is an underwater punching bag device 10 and method of using the same that allows an exerciser a low impact boxing or limited MMA workouts, for example, through the use of water resistance. The air/water/weight combination provides buoyancy and stability to the bag 10 as it is punched and kicked. The exerciser strikes the bag 10 by punching or kicking the bag through the water. By striking the bag 10 through water, water resistance slows the impact, allowing the exerciser to throw punches and kicks with less stress on muscles thereby minimizing injury and allowing improved conditioning of the upper and lower body and the core. Because the bag 10 is filled mainly with water and only provides for floats in the end sections and the wall is composed of a flexible surface, the impact of hands and feet against the side wall is cushioned by water, lessening the chance of injury.

The exerciser would place the bag 10 in a pool or body of water, fill the punching bag 10 with a combination of water, air (used to adjust the buoyancy of the bag 10) and a weight 38. The exerciser strikes the bag 10 by punching through the water to hit the bag 10. The exerciser may also step around the bag 10 and strike from different directions, much like a boxer would move around a boxing ring. The exerciser can also push and pull the bag 10 through the water as well as partially lift the bag 10 out of the water to strengthen arm, leg, and core muscles.

The present invention is unique due to the way the device offers a different method of exercise than conventional punching bags or water therapy devices. The present invention device provides a new form of exercise that can be deployed in nearly any swimming pool or body of water and it provides a unique form of low-impact exercise. It is easy to setup and move. It can be used by adults and children. The bag 10 can be used for exercise, rehabilitation, or recreation.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc., can be used unless specifically indicated otherwise. The relative positions of the elements can vary, and the shapes of elements can vary. Therefore, the scope of the invention should be determined by the appended claims and their legal equivalents, not by the examples given.

What is claimed is:

1. An underwater punching bag device, comprising:

a bag having a bottom section, a mid section, an upper section, a porous support member extending between said upper and said mid section and connected to an internal side of said bag;

a closed cell foam member disposed above said porous support member and maintained in said upper section;

a valve communicably disposed on the bag;

a top opening which extends from a top of said upper section through and communicates with said mid section and said bottom section to permit fluid to pass thereto; and a reclosable member connects to said top about said top opening.

2. The underwater striking bag device of claim 1, further including a weight maintained in said bottom section for stability and buoyancy, maintaining said bag in a vertical position when deposed in water.

3. The underwater striking bag device of claim 2, wherein said weight is a padded weight.

4. The underwater striking bag device of claim 1, further including another porous support member extending between said mid section and said bottom section and connected to said internal side of the bag, and another closed cell foam member below said second porous support member and maintained in said bottom section to maintain said bag in a horizontal position when disposed in water.

5. The underwater striking bag device of claim 1, said valve being disposed in said upper section for receiving air therethrough.

6. The underwater striking bag device of claim 1, wherein said reclosable member is a waterproof seal.

7. The underwater striking bag device of claim 1, wherein the bottom section is configured for removably receiving a weight within an enclosure.

8. The underwater striking bag device of claim 1, further including a transparent window across a section of said bag to permit visual inspection of an amount of fluid therein.

9. The underwater striking bag device of claim 1, wherein said underwater striking bag is made of a flexible water impermeable material.

10. The underwater striking bag device of claim 1, wherein said bottom section includes a tethering attachment area.

11. The underwater striking bag device of claim 1, wherein said reclosable member includes a waterproof zipper connected to said top about said top opening.

12. The underwater striking bag device of claim 1, further including at least one handle connected to said underwater striking bag for assisting in filling and removal of water into said bag.

13. The underwater striking bag device of claim 12, further including at least one handle on said upper section.

14. The underwater striking bag device of claim 12, further including at least one handle on said bottom section.

15. The underwater striking bag device of claim 1, wherein said closed cell foam member is removable from said bag.

* * * * *